United States Patent [19]

Freund

[11] Patent Number: 4,942,628

[45] Date of Patent: Jul. 24, 1990

[54] HELMET SUSPENSION HAVING RATCHET ADJUSTMENT

[75] Inventor: Paul X. Freund, Pittsburgh, Pa.

[73] Assignee: Mine Safety Appliances Company, Pittsburgh, Pa.

[21] Appl. No.: 409,932

[22] Filed: Sep. 20, 1989

[51] Int. Cl.[5] ..... A42B 3/04; A42B 3/14

[52] U.S. Cl. ..... 2/416; 2/410; 2/417; 2/418; 2/420; 74/108; 74/109

[58] Field of Search ..... 2/6, 5, 197, 410, 411, 2/417, 418, 419, 420; 132/57.1, 58, 62, 64.1; 74/109, 108

[56] References Cited

U.S. PATENT DOCUMENTS

| | | | |
|---|---|---|---|
| 631,880 | 8/1899 | Ross | 2/418 |
| 1,288,966 | 12/1918 | Nielsen | 74/109 X |
| 3,040,717 | 6/1962 | Rumsey | 74/109 X |
| 3,329,968 | 7/1967 | Gordon | 2/418 |
| 3,992,720 | 11/1976 | Nicozinas | 2/418 |
| 4,279,037 | 7/1981 | Morgan | 2/421 |
| 4,553,270 | 11/1985 | Hoffman | 2/6 X |
| 4,793,001 | 12/1988 | Accardi | 2/418 |

OTHER PUBLICATIONS

MSA Sales Bulletin 6-01-12 dated Nov. 1988.

MSA Sales Bulletin Data Sheet 06-00-12, dated 1988.

*Primary Examiner*—Werner H. Schroeder

*Assistant Examiner*—Ismael Izaguirre

*Attorney, Agent, or Firm*—Douglas K. McClaine

[57] ABSTRACT

A head protection or helmet suspension is shown having a ratchet adjustment apparatus for the adjustment of the suspension size where the ratchet apparatus is comprised of three parts, all pre-molded of resilient plastic material and having a pre-molded spring fixed around the center of the adjustment knob to engage pins in the ratchet case to lock the suspension size in position. The assembly has no metal parts and is therefore suitable for use around electricity and electrical apparatus.

2 Claims, 2 Drawing Sheets

HELMET SUSPENSION HAVING RATCHET ADJUSTMENT

FIELD OF THE INVENTION

This invention relates to hat and helmet suspensions and particularly to a ratchet mechanism used to adjust the circumference of a suspension.

BACKGROUND OF THE INVENTION

Most types of headgear worn by workers to protect the worker's head from falling objects are held on the worker's head by a suspension system. The suspension system, along with the helmet itself, act to absorb the shock of a falling object striking the worker's head.

The suspension is a web-like support system comprised of two or more strips of material that are arranged to cross each other. The ends of the strips are attached at four or more points around the circumferential interior of the hat or helmet. A headband is then attached to the four or more points of the suspension to permit the helmet to be worn by the worker. A napestrap is attached to one end of the headband. In order to securely position the helmet on the worker's head, it is essential that the circumferences of the suspension be adjustable to fit the appropriate head size.

Two types of helmet suspensions that are now known in the art are the Fas-Trac TM Ratchet Suspension and the Staz-on TM Suspension, both manufactured and sold by Mine Safety Appliances Company of Pittsburgh, Pa. The Staz-on Suspension features an adjustable napestrap that is manually adjusted by the wearer. The two ends of the napestrap are connected and held in place by a slot and teeth arrangement. One end of the napestrap is formed with parallel rows of teeth. The other end of the napestrap is formed with parallel rows of slots. The size of the suspension can then be adjusted by inserting the teeth of one end of the strap into the slots formed in the other end of the strap t the desired length.

The second type of suspension has an adjustable napestrap where the ends of the strap are connected, held in place and adjusted by a ratchet mechanism. The ratchet mechanism operates on a gear and teeth arrangement. The ratchet adjustment knob has attached to it at one end a set of cog teeth. These teeth are then positioned inside of a lateral section of the napestrap. The section of the napestrap has rows of slots formed along the inside of the strap. By placing the adjustment knob in contact with the slot, the size of the napestrap can be adjusted by turning the knob one direction to pull the strap ends closer together or turning the knob the other direction to force the ends apart. A metal spring placed near the adjustment knob locks one of the adjustment knob teeth against a pin attached to the inside of the casing to prevent adjustment knob from turning and the straps ends from pulling apart.

The ratchet suspension is preferred over the adjustable napestrap suspension because the suspension can be easily adjusted while on the head of the worker. There are, however, certain disadvantages to the ratchet type suspension. The ratchet suspension has numerous component parts that must be assembled to operate the ratchet. The number of parts and the labor required to assemble the parts is quite costly. The ratchet suspensions are often so costly that many workers purchase the simple adjustable napestrap even though the adjustable napestrap does not offer the ease of operation or stability of the suspension of that offered by the ratchet. Another disadvantage of the ratchet suspension is the need for the metal spring used to fix the ends of the napestrap together. The metal spring can place an electrical conductor in the hat suspension that can render the suspension unusable for work around electricity or electric wires. Additionally, metal screws are also used to attach the adjustment knob and spring.

The object of this invention is to provide a suspension system that possesses the maneuverability and adjustability of the ratchet system yet is inexpensive to make, easy to assemble and eliminates the metal spring by providing a unique pre-molded spring mechanism in the gear adjustment knob, as well as all other metal parts.

SUMMARY OF THE INVENTION

The present invention provides a ratchet type mechanism to adjust a helmet suspension that has only three parts. All three parts are made of molded resilient plastic. The spring force needed in the ratchet mechanism to lock the adjustment knob against a stationary pin formed inside of the ratchet case is achieved by molding a beveled lip or flange around the outer circumference of the shaft of the adjustment knob. The force provided by the spring must be overcome in order to advance the adjustment knob teeth back and forth past the stationary pins. To prevent the knob from turning and pulling out the ends of the napestrap, the adjustment knob assembly is enclosed and positioned by two case pieces of the mechanism. The ends of the napestrap are also enclosed by the two case pieces. The stationary pins are molded into the top and bottom sections of the case pieces. The molded spring eliminates the need for a separate spring piece in the mechanism while the pre-molded knobs and pieces further eliminate all other conductive metallic parts in the mechanism.

Other features of the invention will become readily apparent to those skilled in the art from the following description of the preferred embodiment. Accordingly, the drawings and description will be regarded as illustrative in nature and not as restrictive.

DETAILED DESCRIPTION OF THE PREFERRED EMBODIMENT

Figure 1B:
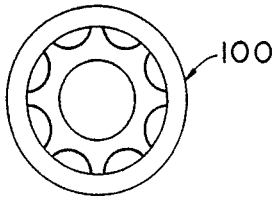
FIG. 1 (*a*) is a front view, FIG. 1(*b*) a side view and FIG. 1(*c*) a three dimensional view of knob 100.
Figure 1A:
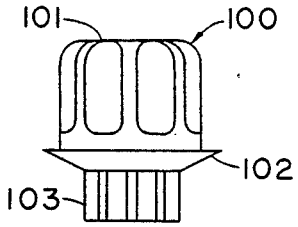
Figure 1C:
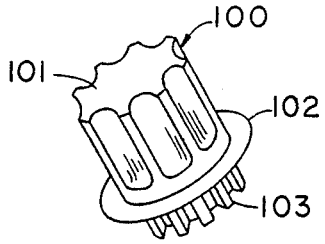

Referring to FIG. 1, a side view and the three-dimensional view of a gear adjustment knob 100 is shown. The knob 100 is a molded plastic piece having three integral, main sections. The first section 101 provides an end piece suitable for gripping and turning by the thumb and finger. The second section is a beveled flange spring 102 that is molded around the outer circumference of the knob 100. The third section of the knob 100 is a circular cog 103 that is axially molded to the knob 100.

Figure 2:
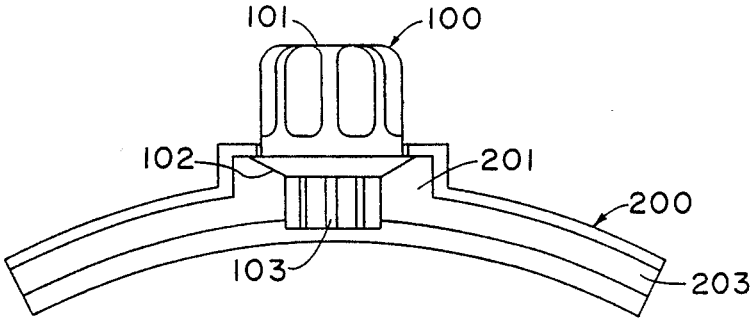
FIG. 2 is a top view of an adjustment knob and bottom ratchet case section with the spring in a relaxed position.
Figure 3:
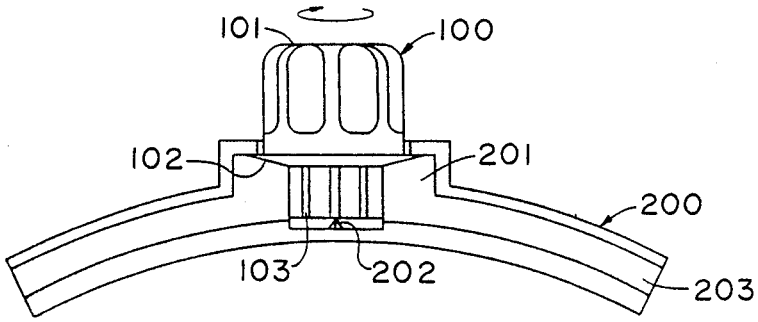
FIG. 3 is a top view of an adjustment knob as it is turned showing the teeth of the knob advancing over a stationary pin as the spring is in a compressed position.
Figure 4:
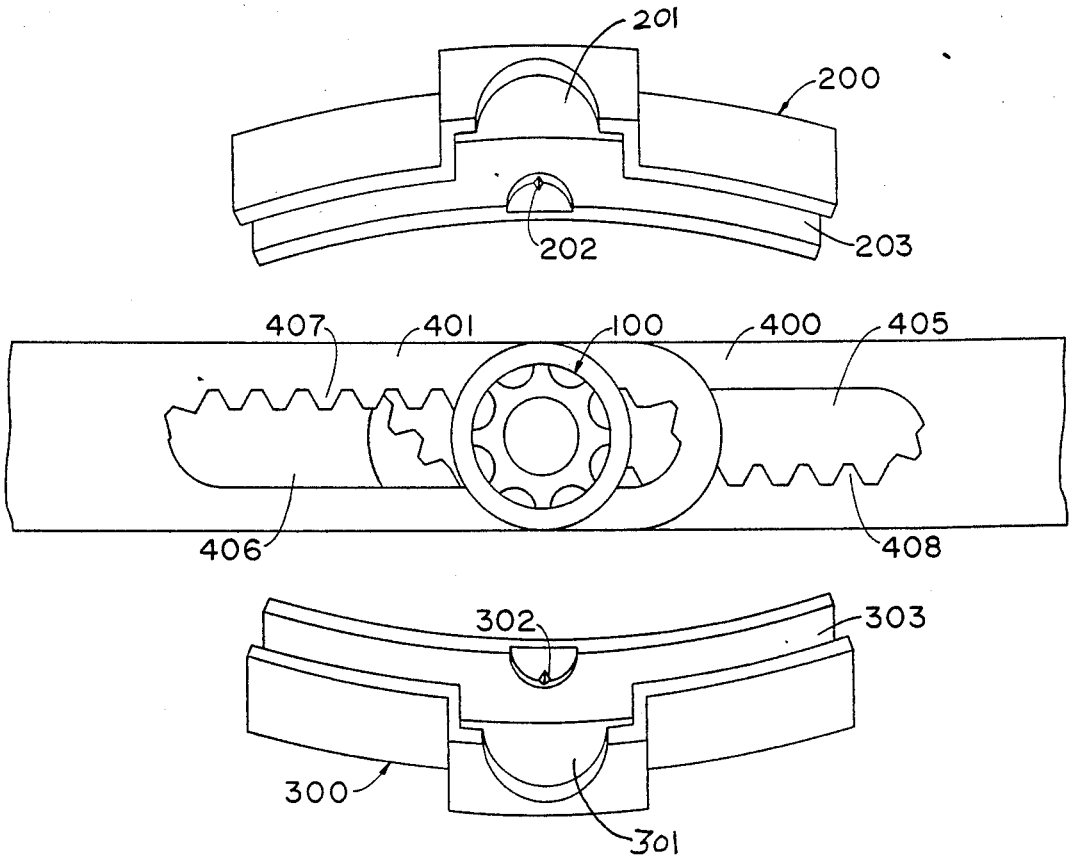
FIG. 4 is an exploded view of a ratchet assembly.

Referring now to FIGS. 2 and 3, the adjustment knob 100 is shown placed inside the bottom half of a ratchet case 200. The ratchet case 200 like the adjustment knob 100 is made of a resilient plastic material. The bottom of the ratchet case 200 is a mirror image of the third piece of the ratchet assembly, the top of the ratchet case 300. Both the top of the case 200 and the bottom of the case 300 are arc shaped and formed with a cavity 201 and 301 to receive and position the knob 100. At the side of the case pieces 200 and 300, facing the inside of the helmet (not shown), stationary pins 302 and 202 (as seen in FIG. 4) are formed of the same plastic materials as used for the other pieces. The pins 202 and 302 act to engage the teeth of the cog 103.

Figure 5:
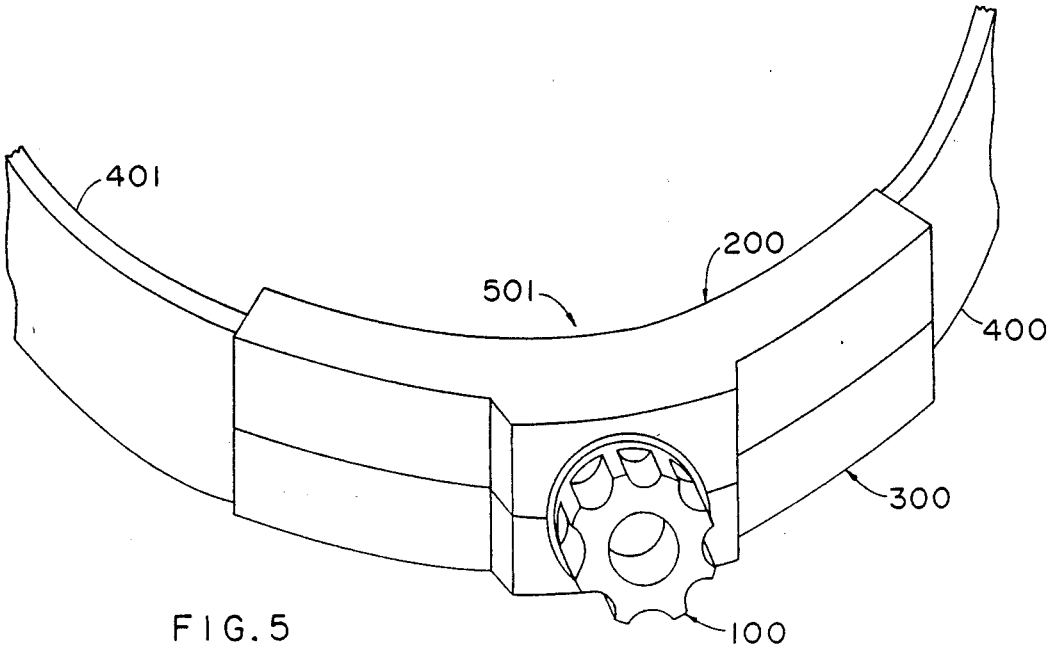
FIG. 5 is an assembled view of the ratchet assembly.

Referring now to FIG. 4, the remaining parts of the ratchet assembly and suspension are shown. The adjusting knob 100 is positioned inside of two lateral grooves 405 and 406 formed inside of two ends of the napestrap. Along the top edge of the lateral groove 406 of one end of the napestrap 401, a row of teeth 407 is cut into the strap suitable to engage the cog teeth 103 of the knob 100. Along the bottom edge of the opposite lateral groove 405, a second row of teeth 408 is formed, again to engage the cog teeth 103 of the knob 100. The two ends of the napestrap of the suspension 400 and 401 are threaded through channels 203 and 303 formed in the top and bottom case pieces 200 and 300. As the pieces 200 and 300 are closed together around the strap ends 400 and 401 and the knob 100, the stationary pins 203 and 302 engage the cog teeth 103 of the knob 100. The two case pieces 200 and 300 are then fixedly connected either by gluing or sonic bonding. The assembled ratchet and napestrap 501 are shown in FIG. 5.

The adjustment of the suspension is achieved by either turning the knob 100 one direction to draw the strap ends 400 and 401 closer together or by turning the knob 100 the other direction to push the strap ends 400 and 401 further apart. The position of the strap ends is locked by the spring force produced by the knob spring as the spring impinges upon the case pieces 200 and 300. As the knob 100 is turned, the cog teeth 103 are forced over the stationary pins 202 and 302 formed inside of the case pieces 200 and 300 as shown in FIGS. 2 and 3. As the knob 100 is turned, the spring 102 is compressed against the case pieces 200 and 300 as the cog teeth 103 ride over the pins 202 and 203. Once the cog teeth 103 pass over the pins 202 and 203, the pins 202 and 203 enter the valleys between the cog teeth 103 and the spring 102 forces the knob 100 back against the case pieces 200 and 300. In order to turn the knob 100, the worker must twist the knob end with his fingers to overcome the force of the spring 102 to allow the knob 100 to turn and the strap ends 400 and 401 to be moved. The entire ratchet assembly can be pre-molded of a resilient plastic material and assembled quickly and easily. The requirement for metal parts has been eliminated by the new design of the spring mechanism formed in the adjustment knob.

The foregoing description of the preferred embodiment is for the purpose of illustration and description. It is to be understood that within the scope of the appended claims, the invention may be practiced otherwise than as specifically illustrated and described.

What is claimed is:

1. An adjustable headband comprising a band having overlapping ends each of said ends having in alignment an elongate slot lengthwise of the band, a first row of teeth formed in the top edge of one of said slots and a second row of teeth formed in the bottom edge of the other said slot, a cylindrical adjusting knob having cog teeth at a first end, gripping means at a second end and a beveled circular lip positioned between said first and second end, case means formed of two case pieces, each said case piece comprising an inner and outer wall forming an arc-shaped channel adapted to receive said band ends and a cavity adapted to receive said adjusting knob, said cavity outer walls having an opening passing said adjusting knob gripping means, said cavity inner walls having a depression adapted to receive said adjusting knob cog teeth, said cog teeth extending through said slots and engaging said first and second rows of teeth, said adjusting knob first end abutting the depression end wall and said beveled circular lip abutting the inner surface of said outer wall, and pin means in said depression to yieldingly engage said cog teeth when the adjusting knob is turned.

2. A ratchet device for moving two band portions in relation to each other comprising overlapping band portions, each of said band portions having in alignment an elongate slot lengthwise of the band, a first row of teeth formed in the top edge of one of said slots and a second row of teeth formed in the bottom edge of the other said slot, a cylindrical adjusting knob having cog teeth at a first end, gripping means at a second end and a beveled circular lip positioned between said first and second end, case means formed of two case pieces, each said case piece comprising an inner and outer wall forming an arc-shaped channel adapted to receive said band portions and a cavity adapted to receive said adjusting knob, said cavity outer walls having an opening passing said adjusting knob gripping means, said cavity inner walls having a depression adapted to receive said adjusting knob cog teeth, said cog teeth extending through said slots and engaging said first and second rows of teeth, said adjusting knob first end abutting the depression end wall and said beveled circular lip abutting the inner surface of said outer wall, and pin means in said depression to yieldingly engage said cog teeth when the adjusting knob is turned.

* * * * *